United States Patent [19]

Hutchinson

[11] 3,973,643

[45] Aug. 10, 1976

[54] DETACHABLE HARNESS FOR FIREMAN'S COAT AND THE LIKE

[76] Inventor: Jack M. Hutchinson, 900 W. Stetson St., Orlando, Fla. 32804

[22] Filed: Dec. 30, 1974

[21] Appl. No.: 537,100

[52] U.S. Cl. ..... 182/3; 2/94
[51] Int. Cl.[2] ..... A62B 35/00
[58] Field of Search ..... 182/3, 4, 5, 6, 7, 8, 182/129; 2/94, DIG. 6; 119/96

[56] References Cited

UNITED STATES PATENTS

| | | | |
|---|---|---|---|
| 380,173 | 3/1888 | Bovensiep | 182/7 |
| 2,970,316 | 2/1961 | Silin | 2/94 |

*Primary Examiner*—Reinaldo P. Machado
*Attorney, Agent, or Firm*—Duckworth, Hobby & Allen

[57] ABSTRACT

A harness is combined with a fireman's turnout coat or similar protective garment of the type adapted to fit about the torso. A belt is provided which encircles the waist, and includes a D-ring and snap, each on opposite sides of the belt for joining the belt together. Releasable fasteners on the inside of the coat allow the belt to be releasably attached thereto. A groin strap is carried by the belt and is adapted to extend between the legs of the wearer so that a snap on the free end thereof may be joined to the D-ring during use. An additional fastener on the inside of the coat allows the strap to be held in a stored position against the inside of the coat when not in use.

11 Claims, 8 Drawing Figures

10
12
13
11
14
16
18
20
22
24
26
42

10
11
15
16
18
19
20
22
24
25
27
30
32
34
36
38
39
40
42
44

15
19
30
32

16
17
20
22
34

FIG 3 (a)
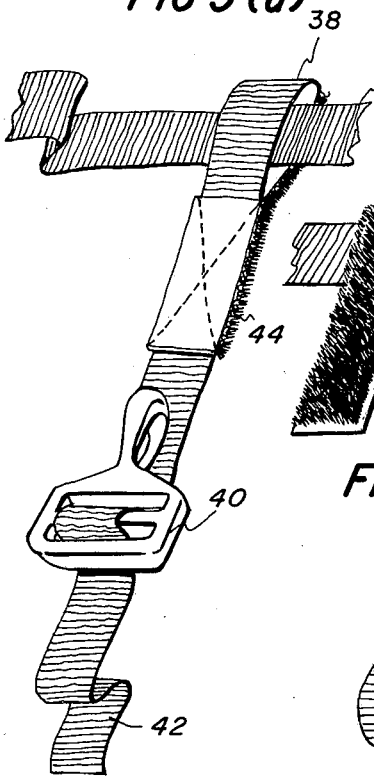
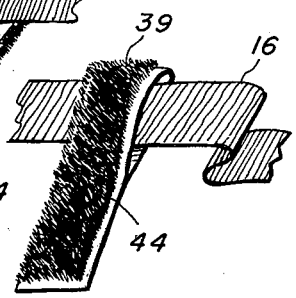
FIG. 3 (b)
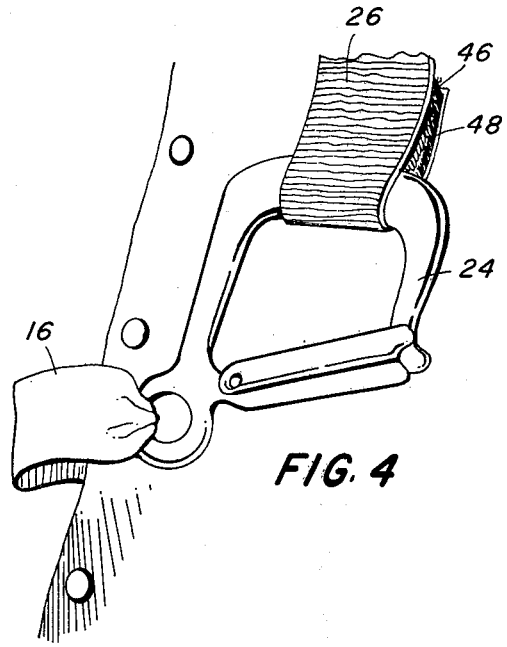
FIG. 4
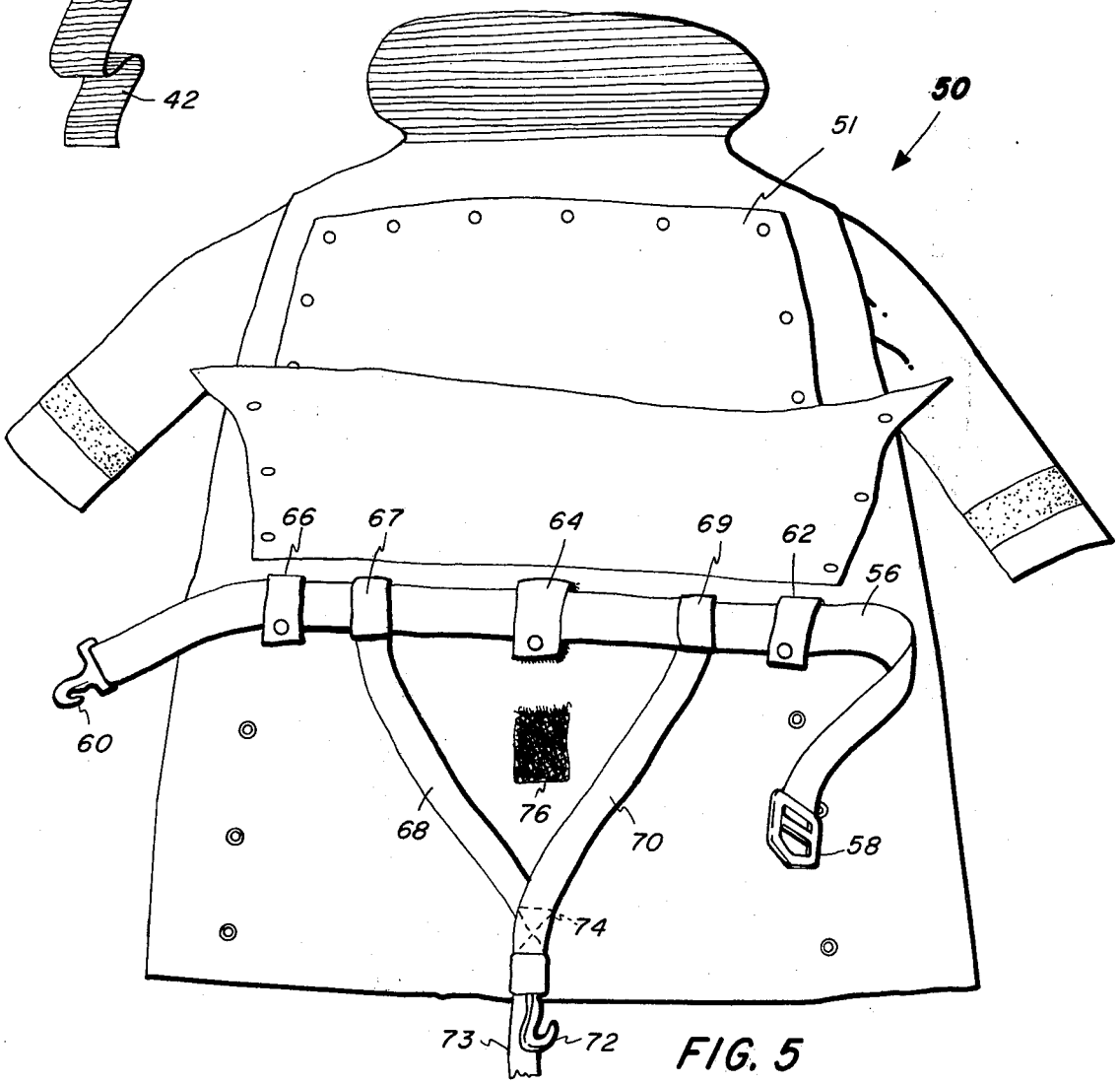
FIG. 5

DETACHABLE HARNESS FOR FIREMAN'S COAT AND THE LIKE

BACKGROUND OF THE INVENTION

1. Field of the Invention

The present invention relates to safety devices, and in particular to safety harnesses for use in combination with firemen's coats and similar protective garments.

2. Description of the Prior Art

Firemen widely employ a protective garment referred to generally as a "turnout coat", which is a heavy, fire retardant knee length jacket carried by the shoulders of the wearer and fitting about the torso thereof. Most of these jackets are fabricated from stiff, uncomfortable material and therefore include a detachable, soft lining therein.

There have been suggestions in the prior art for combining these jackets with a harness arrangement, the harness being either fitted on the inside or outside of the coat. One such arrangement is sold by Eezee Sling Company, Inc., 27 Foundry Street, Central Falls, Rhode Island 02833, and is referred to as the SAV-TEE-HARNESS. This harness includes two straps, one which fits about the waist of the wearer and is joined together by a D-ring fastened to one side thereof and a snap joined to the other side. A second strap is likewise joined at one end to the D-ring and the other snap, and is designed to fit around the buttocks of the wearer, such that when the firemen is rapelling along the side of a building, the strap fitting underneath the buttocks serves as a seat support. This harness is also equipped with a ladder hook joined to the straps and extending outside of the coat, the coat including a snap for holding the ladder hook out of position when not in use. The upper strap is detachably fastened to the inside of the coat, so that the harness may be used apart from the coat itself.

In U.S. Pat. No. 3,498,408, Foote discloses a harness arrangement which may also be employed with a fireman's turnout coat. Other harness and protective garment combinations are disclosed in the following U.S. Pat. Nos.: 3,176,793 to Hlacia; and Hoagland et al, 2,979,153.

Although the turnout coat and harness combinations described above are suitable for some purposes, in many cases the harness slips along the waist and impedes the fireman during operations. It is therefore desirable to employ a groin strap or similar means which allows the harness to be firmly fastened about both the waist and legs. However, there are times when such a groin strap would be uncomfortable and undesirable.

SUMMARY OF THE INVENTION

The present invention contemplates a harness in combination with a garment of the type adapted to fit about the torso of the wearer, the harness including a belt adapted to encircle the waist and means for joining opposite sides of the belt together. Means are provided for releasably attaching the belt to the inside of the coat, and further includes a strap carried by the belt at one end and adapted to extend between the legs of the wearer. Means are provided for joining the other end of the strap with the joined sides of the belt, and additional means are provided for holding the strap in its stored position against the inside of the garment when not in use.

In a preferred embodiment, the belt comprises an endless loop which passes from one side of the coat to the other, such that changes in the length of the belt may be facilitated with one adjustment.

THE DRAWING

Figures 1, 2:
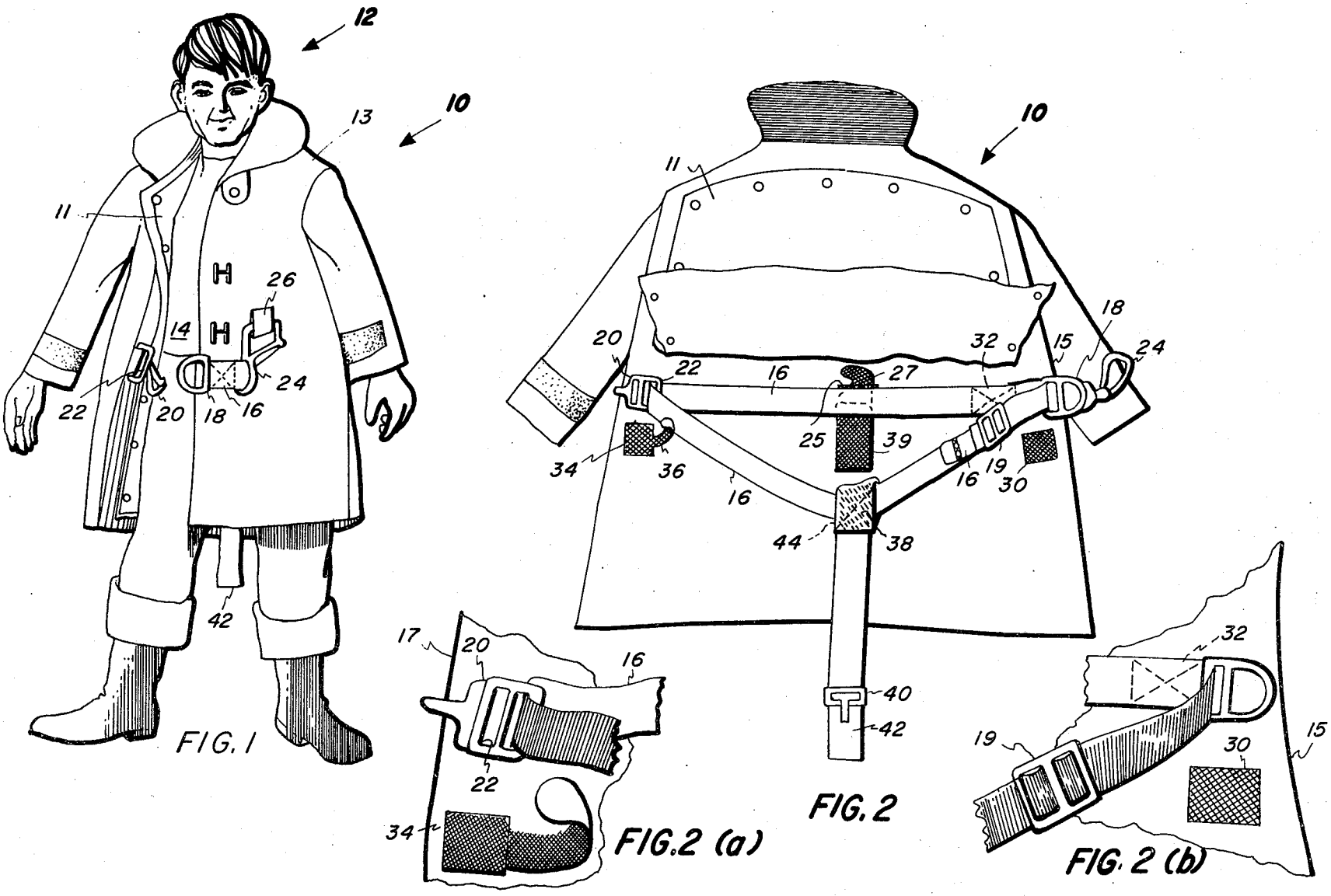
FIG. 1 is an artistic rendering depicting a person wearing a garment and harness combination in accordance with one embodiment of the present invention.
FIG. 2 is a top plan view of a garment-harness combination in accordance with the embodiment of FIG. 1, in which the belt is removed from the releasable fasteners attached to the inside of the garment.

FIGS. 2(*a*) and 2(*b*) illustrate details of FIG. 2.

FIGS. 3(*a*), 3(*b*) and 4 illustrate various details of the embodiment shown in FIGS. 1 and 2.

FIG. 5 is a top plan view of a second embodiment of a garment-harness combination in accordance with the present invention.

DETAILED DESCRIPTION

A preferred embodiment of a harness-garment combination in accordance with the present invention will now be described with reference to FIGS. 1–4.

Noting FIG. 1, the garment-harness combination, referred to generally as 10, has a removable lining 11. The garment may comprise a fireman's turnout coat, for example, and is adapted to be worn by a wearer 12 and supported by the shoulders 13 of the wearer, and includes a portion which fits about the torso 14 of the wearer.

Referring now to both FIGS. 1 and 2, the harness includes a belt adapted to encircle the torso 14 of the wearer 12, the belt preferably comprising a single loop 16 which extends from a first side 15 of the coat and thence to the second side 17, and thence returns to the first side 15, both ends of the belt 16 extending into a buckle 19 so as to facilitate changes in the length of the belt through a single adjustment.

A D-ring 18 is coupled with the loop 16 at the first side 15 of the coat, and a first snap 20 having a slot 22 therein for receiving the loop 16 therethrough is releasably attached to the opposite side 17. The D-ring 18 and the snap 20 comprise standard hardware which is commercially available. A ladder hook 24 is also coupled to a portion of the loop 16 extending outside of the coat, the coat being provided with a releasable fastener 26 for holding the D-ring against the outside of the coat when not in use.

The coat and harness combination 10 is further provided with means for releasably attaching the loop 16 to the inside of the coat. In this embodiment, such means comprise VELCRO fastener arrangements, of the type which are well known. Such VELCRO fasteners generally include a first portion referred to as the "hook", which comprises a plurality of resilient loops which are fabricated together on a flexible substrate. The second portion of the VELCRO fastener is referred to as the "pile", and is a fibrous material which, when placed in contact with the hook, attaches thereto until such time as sufficient force is exerted to overcome the coupling of the pile to the hook.

Referring specifically to FIGS. 2, 2(*a*) and 2(*b*), a first VELCRO fastener is provided adjacent the first side 15 of the coat, and includes a first position 30 which is glued or sewn to the inside of the coat. The second portion 32 of the fastener is sewn to the back of the loop 16 adjacent the D-ring 18. Either portion 30, 32 of this first fastener may comprise the hook or pile, or vice versa. A second fastener is provided adjacent the second side of the coat, and includes a first portion 34 having a tongue 36 sewn along one edge of the first portion 34, such that the tongue may be inserted through the slot 22 in the snap 20. In the same manner as with the first and second portions 30 and 32, the first portion 34 of the second fastener and the tongue may either comprise the hook or pile, such that when the tongue is inserted in the slot and pressed against the first portion 34, it is fastened thereto. Additionally, another VELCRO fastener portion 25 is attached to the inside of the coat intermediate the sides 15, 17 and includes a tongue 27 which encircles the loop 16 for holding the belt.

In accordance with the present invention, the harness is provided with a groin strap which is joined to the loop 16 and includes means for storing the groin strap out of position when not in use. Noting FIGS. 1 and 2, the groin strap includes an endless loop 38 which is loosely fitted about the loop 16. A strap 42 is formed integrally with the loop 38, and includes a snap 40 similar to snap 20 slidably attached to the strap 42. A similar VELCRO fastening arrangement is provided so as to store the groin strap out of position; in this embodiment, this fastener includes a VELCRO hook or pile portion 39 which is glued or otherwise attached to the inside of the coat between the fastener portions 30 and 34, and somewhat below the center line thereof. A second portion 44 of this fastener is sewn to the back to the strap 42, as is shown in greater detail in FIGS. 3(*a*) and (*b*). When not in use, the fastener portion 44 is joined to the coat portion 39, holding the strap in a stored position against the inside of the coat. An end portion of the strap 42 extends below the bottom level of the coat, which allows the wearer 12 to facilitate use of the groin strap by reaching between his legs and yanking the strap from the stored position. The snap 40 may then be coupled to the D-ring 18 along with the snap 20, effecting a harness which fits about the waist of the wearer, and additionally includes a firm groin strap therewith for preventing movement of the harness.

A second embodiment of a garment-harness combination in accordance with the present invention is shown in FIG. 5. This embodiment, referred to generally as 50, includes a liner 51, and a belt 56 having a D-ring 58 and a snap 60 on opposite ends thereof, in a manner similar to the loop 16 of FIG. 1. The inside of the coat is provided with a plurality of detachable loops, including three loops 62, 64 and 66, through which the belt 56 is inserted. The harness is provided with two groin straps 68 and 70, each of which includes a slidable loop 67, 69 respectively. The two groin straps 68, 70 are sewn together along with a fastener portion 74, which is adapted to join with a second fastener portion 76 glued or sewn to the inside of the coat. A snap 72 is coupled to the sewn groin straps 68, 70 and includes an end portion 73 adapted to serve the same portion as the end of the strap 42, when the fastener portion 74, 76 are utilized to store the groin strap.

I claim:

1. A harness in combination with a garment comprising:

a garment adapted to fit about the torso of a wearer;

a belt adapted to encircle the waist of the wearer;

means for rapidly joining and releasing the opposite ends of said belt;

a strap having two ends and carried by said belt at one end between the ends of said belt, said strap adapted to extend between the legs of said wearer of said garment;

means for rapidly joining and releasing the other end of said strap with the joined ends of said belt; and means for holding part of said strap in a stored position against the inside of said garment when not in use, leaving one end thereof free to facilitate removal of said strap from said stored position.

2. A harness in combination with a garment as recited in claim 1 further comprising means for releasably attaching said belt to the inside of said garment.

3. A harness in combination with a garment as recited in claim 2 wherein said belt comprises a loop passing from one side of said garment to the other side, to said one end of said strap and thence again to said one side of said garment.

4. A harness in combination with a garment as recited in claim 3 wherein one end of said loop is joined at said one side of said garment.

5. A harness in combination with a garment as recited in claim 4 wherein said releasable attaching means comprises releasable fasteners on the inside of said garment at said one and other sides.

6. A harness in combination with a garment as recited in claim 5 wherein said garment further includes a liner attached to the inside of said garment, said loop passing between said garment and said liner.

7. A harness in combination with a garment as recited in claim 6 wherein said joining means comprises:

a D-ring coupled to said loop at either of said one or other sides;

a first snap coupled to the side opposite said D-ring and adapted to engage said D-ring; and a second snap coupled to the other end of said strap and adapted to engage said D-ring.

8. A harness in combination with a fireman's turnout coat comprising:

a fireman's turnout coat or similar protective garment of the type adapted to be carried by the shoulders of the wearer and having a portion adapted to fit about the torso of said wearer;

a belt adapted to encircle the waist of said wearer;

means for joining opposite sides of said belt together;

a strap carried by said belt at one end and adapted to extend between the legs of said wearer;

means for holding part of said strap in a stored position against the inside of said garment when not in use;

means for releasably attaching said belt to the inside of said coat; and wherein said strap holding means allows a portion of said strap to hang downward whereby release of said strap from said holding means can be effected by said wearer without removal of said garment.

9. A harness in combination with a fireman's turnout coat as recited in claim 8 further comprising a ladder hook attached to said belt and adapted to extend outside of said coat.

10. A harness in combination with a fireman's turnout coat as recited in claim 9 further comprising means for releasably holding said hook against the outside of said coat.

11. A safety harness for firemen and the like comprising:

a D-ring;

a first snap hook;

a web loop forming a waist strap passing from said D-ring to said first snap hook and a buttock strap passing from said first snap hook back to said D-ring;

a groin strap attached at one end to said buttock strap;

a second snap hook attached at the other end of said groin strap for joining said other end of said groin strap to said D-ring; and wherein the length of said waist band and said buttock straps may be changed by a single adjustment along said web loop.

* * * * *